US006009674A

United States Patent [19]

Root

[11] Patent Number: 6,009,674

[45] Date of Patent: Jan. 4, 2000

[54] METHOD AND APPARATUS FOR PROVIDING EARTHQUAKE RESISTANT MODULAR STRUCTURES

[76] Inventor: Warren N. Root, 24921 Muirlands, Unit 112, Lake Forest, Calif. 92630

[21] Appl. No.: 08/976,890

[22] Filed: Nov. 24, 1997

Related U.S. Application Data

[60] Provisional application No. 60/033,492, Dec. 20, 1996, and provisional application No. 60/046,019, May 9, 1997.

[51] Int. Cl.[7] ..... E02D 27/00

[52] U.S. Cl. ..... 52/167.3; 52/126.7; 52/169.9; 52/236.3; 52/653.1

[58] Field of Search ..... 52/126.7, 167.3, 52/236.3, 236.6, 236.7, 236.9, 653.1, 169.9

[56] References Cited

U.S. PATENT DOCUMENTS

| | | | |
|---|---|---|---|
| 2,943,716 | 7/1960 | Babcock | 52/653.1 |
| 3,380,205 | 4/1968 | Ratchford | 52/126.7 |
| 3,593,477 | 7/1971 | Briggs | 52/295 X |
| 4,261,149 | 4/1981 | Gustafson | 52/292 |
| 4,417,426 | 11/1983 | Meng | 52/126.7 |
| 4,546,581 | 10/1985 | Gustafson | 52/126.6 X |
| 5,660,017 | 8/1997 | Houghton | 52/236.6 X |

*Primary Examiner*—Carl D. Friedman
*Assistant Examiner*—Timothy B. Kang
*Attorney, Agent, or Firm*—Knobbe, Martens, Olson & Bear, LLP

[57] ABSTRACT

A method and apparatus for connecting modular structures include I-beams which are placed beneath and longitudinally perpendicularly to the integral longitudinal supporting beams of the modular structures. A pair of upper plates and a pair of lower plates are positioned with respect to the upper beams and the lower I-beams, respectively. Bolts are passed through the upper plates and the lower plates, and nuts are tightened on the plates to cause the upper and lower beams to be clamped together. The plates are installed on the beams without requiring any structural modification of the beams, such as, for example, cutting, drilling, welding, or the like. Thus, the beams are not weakened by the process, and the modular structures can be readily disconnected and transported to another location for reconnection. The method and apparatus also include support structures which support the lower beams and which can be adjusted to comply with variations in the elevation of the ground or platform on which the modular structures are located. As with the interconnecting plates, the support structures are installed without requiring any structural modification of the beams.

16 Claims, 7 Drawing Sheets

METHOD AND APPARATUS FOR PROVIDING EARTHQUAKE RESISTANT MODULAR STRUCTURES

RELATED APPLICATIONS

The present application claims the benefit of priority under 35 U.S.C. § 119(e) of U.S. Provisional Patent Application No. 60/033,492 filed on Dec. 20, 1996 and U.S. Provisional Patent Application No. 60/046,019 filed on May 9, 1997.

BACKGROUND OF THE INVENTION

1. Field of the Invention

The present invention is in the field of building construction, and, more particularly, is in the field of interconnecting modular structures to provide an earthquake resistant building.

2. Description of the Related Art

Modular homes are prefabricated in sections and are delivered to their respective home site locations. The modules are conventionally connected with the use of nails and screws after they are set in place. This method of connection is very inadequate during land motion, such as a major tremor. In particular, the movement of the modules during such land motion will tend to cause the modules to become disconnected, thus causing damage to the modules and to the contents of the modules. Furthermore, occupants of the modules, particularly those located at the junctions of the modules may be injured by the failure of the connections between the modules. Thus, a need exists for a method and apparatus for interconnecting modules to maintain the structural interconnection between the modules during land motion. Furthermore, such a method and apparatus should enable the modules to be easily interconnected by field personnel and to be later disconnected by such field personnel so that the modules can be moved to other locations.

SUMMARY OF THE INVENTION

With the earthquake tie method in accordance with the present invention, the modules are completely connected together at the base with structural I-beams, creating a very strong homogeneous structure that will maintain its total integrity during most major tremors.

One aspect of the present invention is an apparatus for interconnecting first and second flanged beams without modifying the beams, wherein the first beam is positioned to cross over the second beam. The apparatus comprises a first plate positioned on a first flange of the first beam. The first plate has a width sufficient that a portion of the first plate extends beyond the first flange of the first beam. The portion of the first plate has respective first and second holes formed therein. A second plate is positioned on a second flange of the first beam. The second plate is disposed opposite the first plate. The second plate has a width sufficient that a portion of the second plate extends beyond the second flange of the first beam. The portion of the second plate has respective first and second holes formed therein. A third plate is positioned on a first flange of the second beam. The third plate has a width sufficient that a portion of the third plate extends beyond the first flange of the second beam. The portion of the third plate has respective first and second holes formed therein. The third plate is positioned with the first hole of the third plate aligned with the first hole of the first plate and with the second hole of the third plate aligned with the first hole of the second plate. A fourth plate is positioned on a second flange of the second beam. The fourth plate is disposed opposite the third plate. The fourth plate has a width sufficient that a portion of the fourth plate extends beyond the second flange of the second beam. The portion of the fourth plate has respective first and second holes formed therein. The fourth plate is positioned with the first hole of the fourth plate aligned with the second hole of the first plate and with the second hole of the fourth plate aligned with the second hole of the second plate. A first fastener passes through the first hole of the first plate and the first hole of the third plate. A second fastener passes through the second hole of the first plate and the first hole of the fourth plate. A third fastener passes through the first hole of the second plate and the second hole of the third plate. A fourth fastener passes through the second hole of the second plate and the second hole of the fourth plate. The fasteners are tightened to securely clamp the flanges of the first and second beams between the first and second plates. Preferably, the first, second, third and fourth plates are rectangular. Also, preferably, the first, second, third and fourth plates comprise structural steel. In particularly preferred embodiments, each of the first, second, third and fourth fasteners comprises a bolt and a nut which is threaded onto the bolt to tighten the each fastener.

Another aspect of the present invention is an apparatus for reducing movement of first and second interconnected modular structures subject to external forces, such as earth motion. The apparatus comprises a first flanged support beam positioned beneath the first modular structure. The first beam is oriented in a first direction. A second flanged support beam is positioned beneath the second modular structure. The second support beam is oriented parallel to the first support beam in the first direction. A third flanged support beam is positioned beneath the first support beam and the second support beam and oriented in a second direction so that the third flanged support beam crosses the first and second flanged support beams. A first clamp is positioned to grip flanges of the first support beam and flanges of the third support beam to secure the first support beam to the third support beam without modifying the structure of either the first support beam or the third support beam. A second clamp is positioned to grip flanges of the second support beam and flanges of the third support beam to secure the second support beam to the third support beam without modifying the structure of either the second support beam or the third support beam. In preferred embodiments, each of the first clamp and the second clamp comprises a first plate positioned on a first flange of the first beam. The first plate has a width sufficient that a portion of the first plate extends beyond the first flange of the first beam. The portion of the first plate has respective first and second holes formed therein. A second plate is positioned on a second flange of the first beam. The second plate is disposed opposite the first plate. The second plate has a width sufficient that a portion of the second plate extends beyond the second flange of the first beam. The portion of the second plate has respective first and second holes formed therein. A third plate is positioned on a first flange of the second beam. The third plate has a width sufficient that a portion of the third plate extends beyond the first flange of the second beam. The portion of the third plate has respective first and second holes formed therein. The third plate is positioned with the first hole of the third plate aligned with the first hole of the first plate and with the second hole of the third plate aligned with the first hole of the second plate. A fourth plate is positioned on a second flange of the second beam. The fourth plate is disposed opposite the third plate. The fourth plate has a width sufficient that a portion of the fourth plate extends beyond the second flange of the second beam. The portion of the fourth plate has respective first and second holes formed therein. The fourth plate is positioned with the first hole of the fourth plate aligned with the second hole of the first plate and with the second hole of the fourth plate aligned with the second hole of the second plate. A first fastener passes through the first hole of the first plate and the first hole of the third plate. A second fastener passes through the second hole of the first plate and the first hole of the fourth plate. A third fastener passes through the first hole of the second plate and the second hole of the third plate. A fourth fastener passes through the second hole of the second plate and the second hole of the fourth plate. The fasteners are tightened to securely clamp the flanges of the first and second beams between the first and second plates. Preferably, the first, second, third and fourth plates are rectangular. Also, preferably, the first, second, third and fourth plates comprise structural steel. In particularly preferred embodiments, each of the first, second, third and fourth fasteners comprises a bolt and a nut which is threaded onto the bolt to tighten the each fastener.

Another aspect of the present invention is a method of interconnecting flanged beams. The method comprises the step of positioning a first plate on a first flange of the first beam with a first portion of the first plate in contact with the first flange and with a second portion of the first plate extending beyond the first flange of the first beam. The second portion of the first plate has respective first and second holes formed therein. A second plate is positioned on a second flange of the first beam opposite the position of the first plate. The second plate is positioned with a first portion in contact with the second flange of the first beam and with a second portion extending beyond the second flange of the first beam. The second portion of the second plate has respective first and second holes formed therein. A third plate is positioned on a first flange of the second beam with a first portion of the third plate in contact with the first flange of the second beam and with a second portion of the third flange extending beyond the first flange of the second beam. The second portion of the third plate has respective first and second holes formed therein. The third plate is positioned on the first flange of the second beam to align the first hole of the third plate with the first hole of the first plate and to align the second hole of the third plate with the first hole of the second plate. A fourth plate is positioned on a second flange of the second beam opposite to the position of the third plate. The fourth plate is positioned with a first portion of the fourth plate in contact with the second flange of the second beam and with a second portion extending beyond the second flange of the second beam. The second portion of the fourth plate has respective first and second holes formed therein. The fourth plate is positioned on the second flange of the second beam to align the first hole of the fourth plate with the second hole of the first plate and to align the second hole of the fourth plate with the second hole of the second plate. The method includes the further step of passing a first fastener through the first hole of the first plate and the first hole of the third plate. A second fastener passes through the second hole of the first plate and the first hole of the fourth plate. A third fastener passes through the first hole of the second plate and the second hole of the third plate. A fourth fastener passes through the second hole of the second plate and the second hole of the fourth plate. The method includes the further step of tightening the first, second, third and fourth fasteners to securely clamp the flanges of the first and second beams between the first and second and the third and fourth plates. Preferably, the first, second, third and fourth plates are rectangular. Also preferably, the first, second, third and fourth plates comprise structural steel.

Another aspect of the present invention is a method of interconnecting modular structures. The method comprises the step of positioning a first support beam beneath the first modular structure with the first beam oriented in a first direction. A second support beam is positioned beneath the second modular structure with the second support beam oriented parallel to the first support beam in the first direction. A third support beam is positioned beneath the first support beam and the second support beam and is oriented in a second direction such that the third support beam crosses the first and second support beams. The method includes the further steps of clamping the third support beam to the first support beam, and clamping the third support beam to the second support beam.

Another aspect of the present invention is an adjustable support for a horizontally disposed flanged beam having first and second flanges on a lower portion thereof. The support comprises a support column which provides a first non-varying length for the support. The column has a first end which rests on a supporting surface and has a second end. First, second, third and fourth threaded support members are positioned proximate to the second end of the support column. The first, second, third and fourth threaded support members are oriented in parallel with each other and in parallel with the support column. First, second, third and fourth threaded adjustment members are positioned on the first, second, third and fourth threaded support members, respectively. The threaded adjustment members rotate on the support members to move up and down the support members to thereby vary a distance of each of the adjustment members from the first end of the support column. A first plate has first and second holes. The first plate is positioned on the first and second threaded adjustment members with the first and second threaded support members passing through the first and second holes, respectively. A second plate has first and second holes. The second plate is positioned on the third and fourth threaded adjustment members generally in parallel with the first plate with the third and fourth threaded support members passing through the first and second holes, respectively. The first and second flanges of the flanged beam rest on the first and second plates and are positioned with the first and fourth threaded members proximate to the first flange and with the second and third threaded members proximate to the second flange. A third plate is positioned over the first flange with a first portion of the third plate contacting the first flange and with a second portion of the third plate extending beyond the first flange. The second portion has a first hole and a second hole. The first threaded member passes through the first hole of the third plate. The fourth threaded member passes through the second hole of the third plate. A fourth plate is positioned over the second flange with a first portion of the fourth plate contacting the second flange and with a second portion of the fourth plate extending beyond the second flange. The second portion has a first hole and a second hole. The second threaded member passes through the first hole of the fourth plate. The third threaded member passes through the second hole of the fourth plate. First, second, third and fourth threaded fasteners are applied to the first, second, third and fourth threaded support members, respectively, above the third and fourth plates. The first, second, third and fourth fasteners clamp the first and second flanges between the first and second plates and the third and fourth plates when the threaded fasteners are rotated to advance the threaded fasteners toward the threaded adjustment members. Preferably, the first, second, third and fourth plates are rectangular. Also preferably, the first, second, third and fourth plates comprise structural steel.

A further aspect of the present invention is an adjustable support for a horizontally disposed flanged beam having first and second flanges on a lower portion thereof. The support comprises a support column which provides a first non-varying length for the support. The column has a first end which rests on a supporting surface and has a second end. First, second, third and fourth vertical support members are positioned proximate to the second end of the support column. First, second, third and fourth adjustment members are positioned on the first, second, third and fourth support members, respectively. The adjustment members are movable along the support members to vary a vertical distance of the support members from the surface. A first plate is mounted on the first and second support members above the first and second adjustment members. A second plate is mounted on the third and fourth support members above the third and fourth adjustment members. The second plate is generally in a same plane with the first plate so that the first and second flanges of the flanged beam rests on the first and second plates. A third plate is mounted on the first and fourth support members and is positioned over the first flange. A fourth plate is mounted on the second and third support members and is positioned over the second flange. First, second, third and fourth fasteners are applied to engage the first, second, third and fourth support members, respectively, above the third and fourth plates. The fasteners are movable toward the adjustment members to clamp the first and second flanges between the first and second plates and the third and fourth plates.

BRIEF DESCRIPTION OF THE DRAWINGS

The present invention will be described below in connection with the accompanying drawing figures in which.

DETAILED DESCRIPTION OF THE PREFERRED EMBODIMENT

Figure 1:
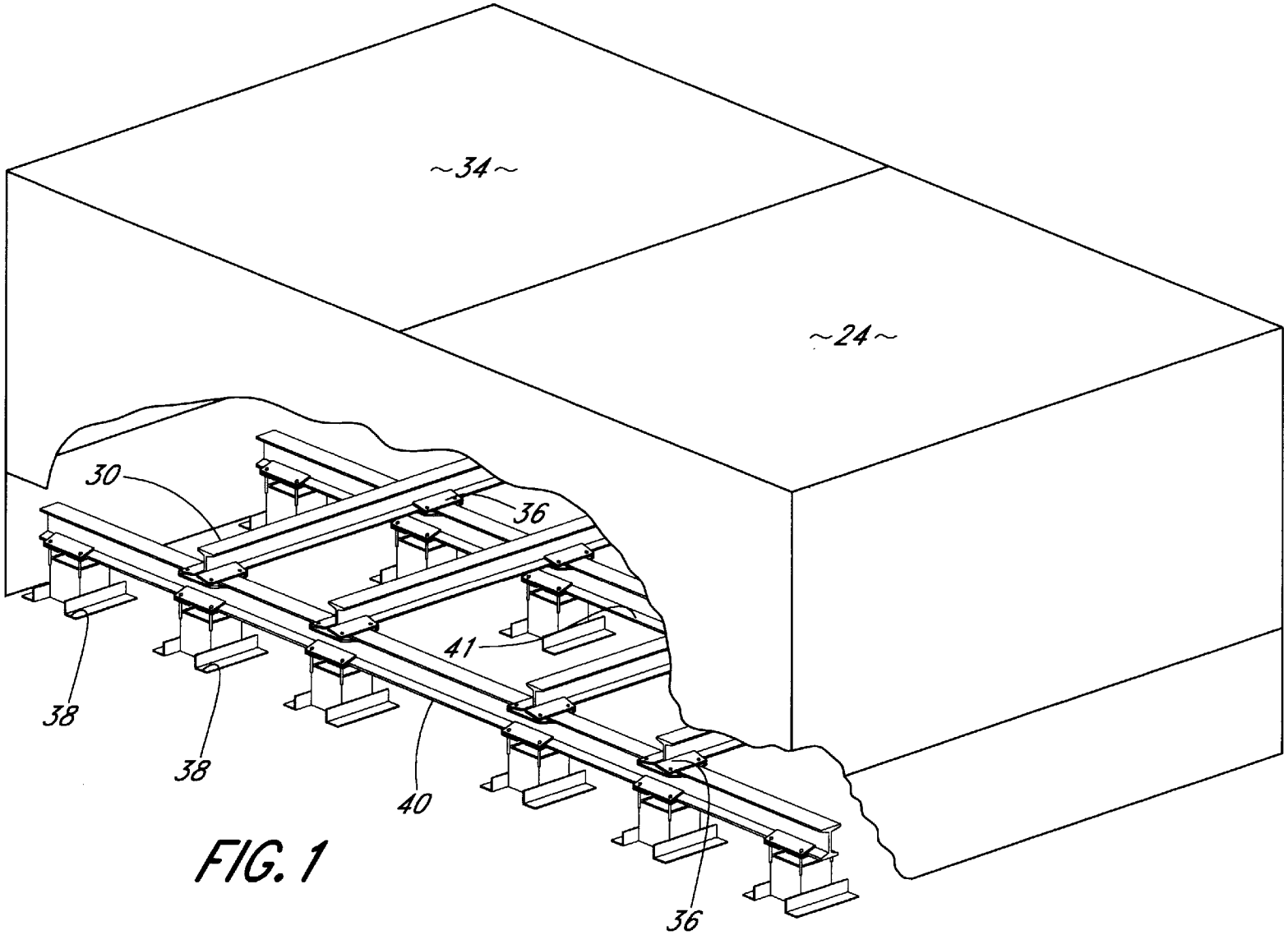
FIG. 1 illustrates a perspective view of two modules interconnected in accordance with the method and apparatus of the present invention, wherein portions of the modules are broken away to show the interconnection devices and the support structures of the present invention.
Figure 2:
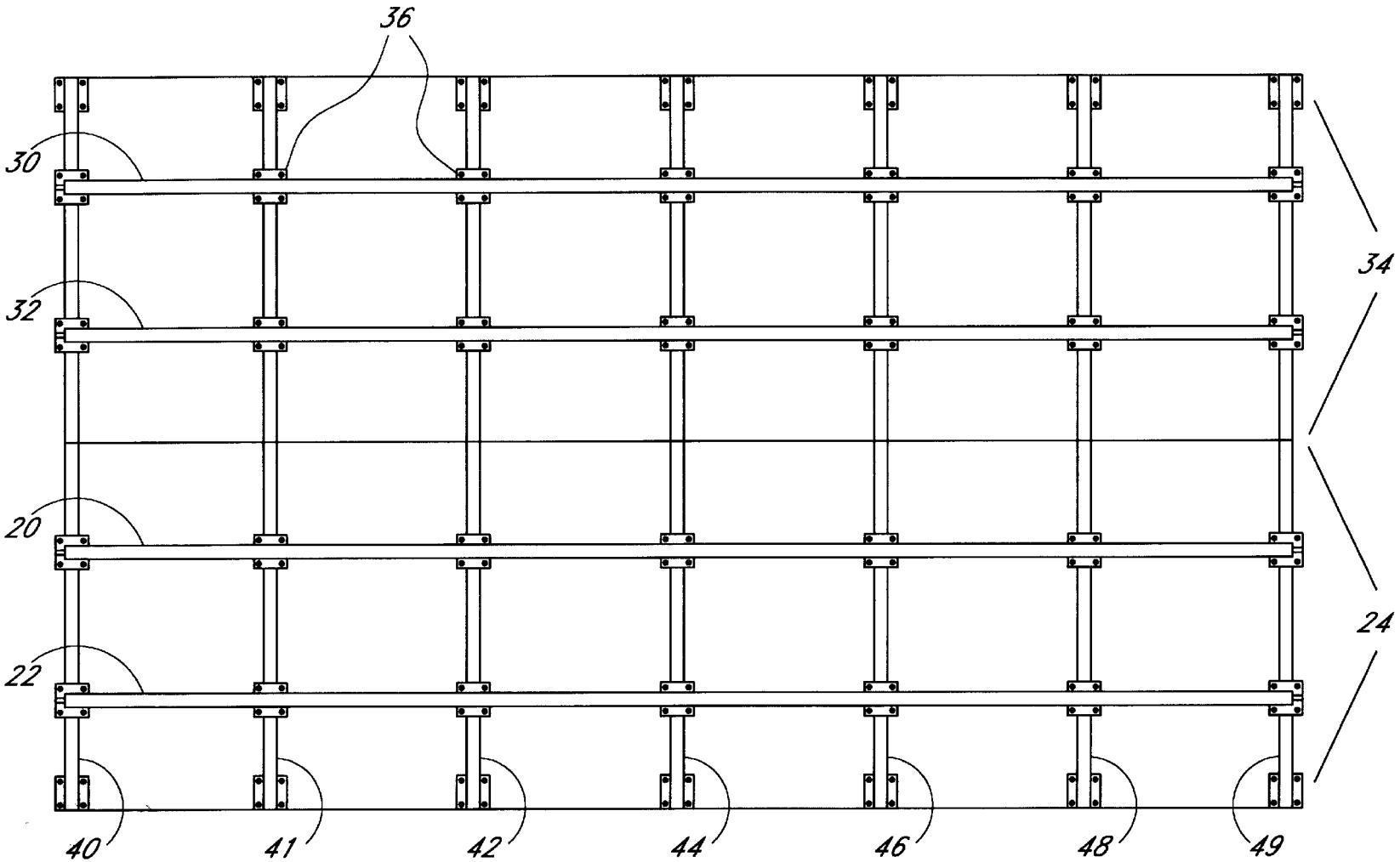
FIG. 2 illustrates an upper plan view of the interconnection system of the present invention as shown in FIG. 1 but with the modules removed.

A first module 24 and a second module 34 are illustrated in FIG. 1. The modules 24, 34 may be conventional modules, such as, for example, the modules of an exemplary modular home, modular office, or the like. FIGS. 1 and 2 show the existing module I-beams 20, 22, 30, 32 which are part of the subfloor of each prefabricated module 24, 34. FIGS. 1 and 2 also show support I-beams 40, 41, 42, 44, 46, 48, 49 which are set in place at the construction site and rest on foundation support piers 38 (described in more detail below). The support I-beams 40, 41, 42, 44, 46, 48, 49 function to cross-tie the two modules 24, 34 together and to transfer the load of the modules 24, 34 to the piers 38 and thus to the ground on which the piers stand. The support I-beams and the module I-beams are coupled together with sets of coupling plates 36 (described in more detail below).

Figure 3:
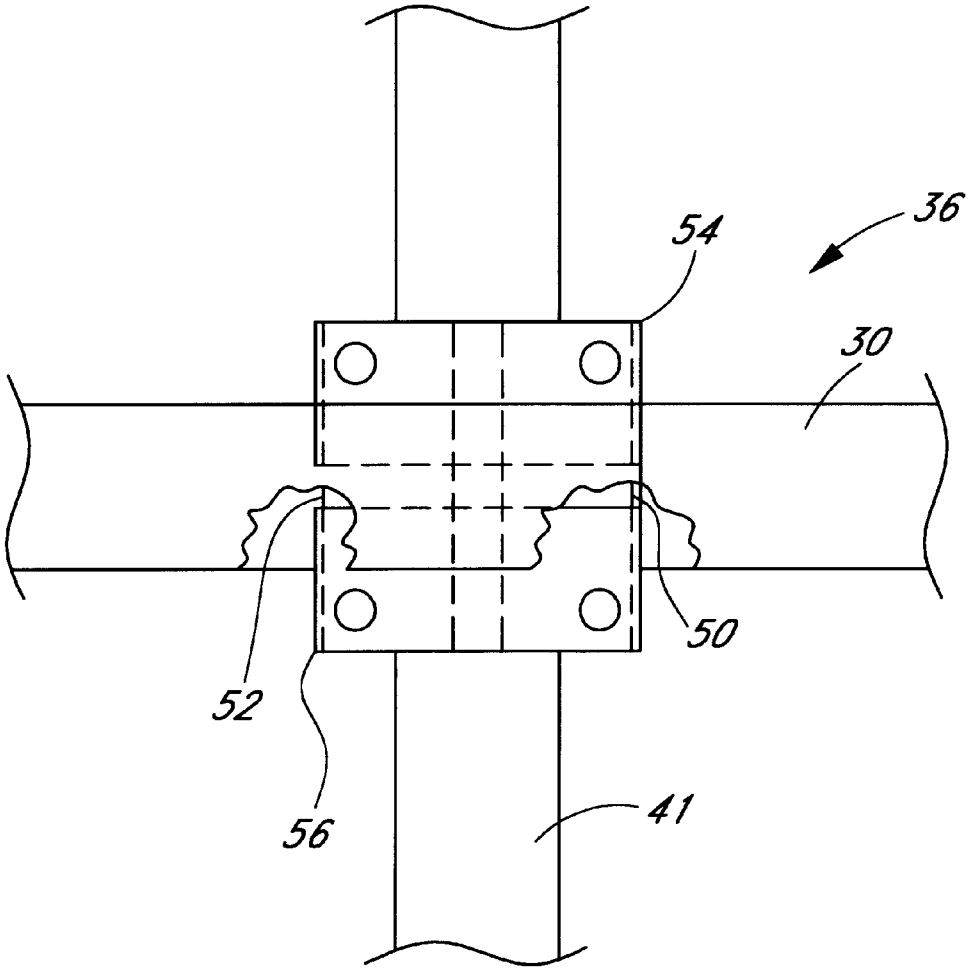
FIG. 3 illustrates an enlarged plan view of one of the interconnection devices of FIGS. 1 and 2.
Figure 4:
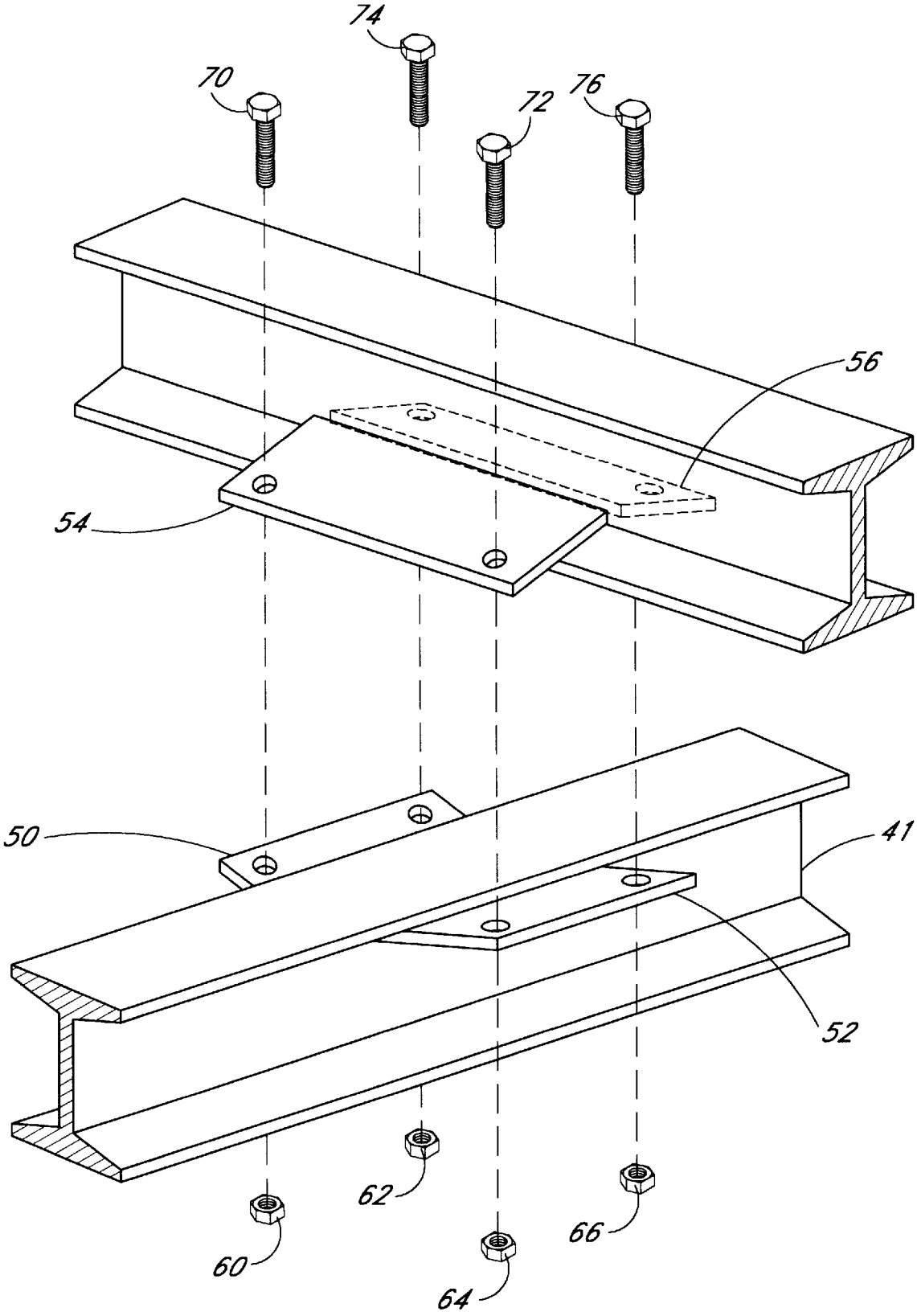
FIG. 4 illustrates an exploded perspective view of the interconnection of FIG. 3 showing the positioning of the plates with respect to the crossing I-beams.

As illustrated in FIGS. 3 and 4, the method of the present invention only requires four equal size plates 50, 52, 54, 56 of structural steel in each set of coupling plates 36 at each of the crossings between the existing module I-beams 20, 22, 30, 32 and the support I-beams 40, 41, 42, 44, 46, 48, 49. For illustrative purposes, the connection between the module I-beam 30 and the support I-beam 41 is shown. The plates 50, 52, 54, 56 are generally rectangular and are sized as shown to be compatible with the sizes of the I-beams. Each of the plates 50, 52, 54, 56 has two holes proximate to two adjacent corners of the plate. As described below, a respective fastener, such as a bolt 70, 72, 74, 76, is positioned through each of the holes, and a respective nut (e.g., a lock nut) 60, 62, 64, 66, or other tightening device, is used to tighten the plates 50, 52, 54, 56 against the module I-beam 30 and against the support I-beam 41.

To assemble the present invention, the modules 24, 34 are placed over the horizontally disposed support I-beams 40, 41, 42, 44, 46, 48, 49 with the existing module I-beams 20, 22, 30, 32 substantially perpendicular (i.e., orthogonal) to the support I-beams. That is, the module I-beams lie in a first horizontal direction which is substantially at a right angle to a second horizontal direction in which the support I-beams lie. The flanges of each I-beam are substantially horizontal so that the "I" section of each I-beam is substantially vertical as shown.

As further shown in FIGS. 3 and 4 for the module I-beam 30, the plates 54, 56 are placed at the I-beam vertex with the plates 54, 56 on each side of the inside lip at the bottom of the "I" section of the existing module I-beam 30. The holes in the plates 54, 56 are positioned with the holes exposed outside the lip of the I-beams.

The plates 50, 52 are positioned in a similar manner under the top lip of the "I" section of the support I-beam 41 such the plates 50, 52 are oriented substantially perpendicular to the plates 54, 56. The holes of the plates 50, 52 are aligned with the holes of the plates 54, 56 such that the first hole of the plate 50 is aligned with the first hole of the plate 54, the second hole of the plate 50 is aligned with the first hole of the plate 56, the first hole of the plate 52 is aligned with the second hole of the plate 54, and the second hole of the plate 52 is aligned with the second hole of the plate 56.

A respective one of the bolts 70, 72, 74, 76 is positioned through each pair of aligned holes and fastened with one of the nuts 60, 62, 64, 66. The assembly is then tightened with a torque wrench, or the equivalent, with a sufficient torque to accommodate the loading of the completed structure.

The foregoing steps are repeated for each of the sets of connecting plates 36 at the intersections of the module I-beams 20, 22, 30, 32 with the support I-beams 40, 41, 42, 44, 46, 48, 49.

Figure 5:
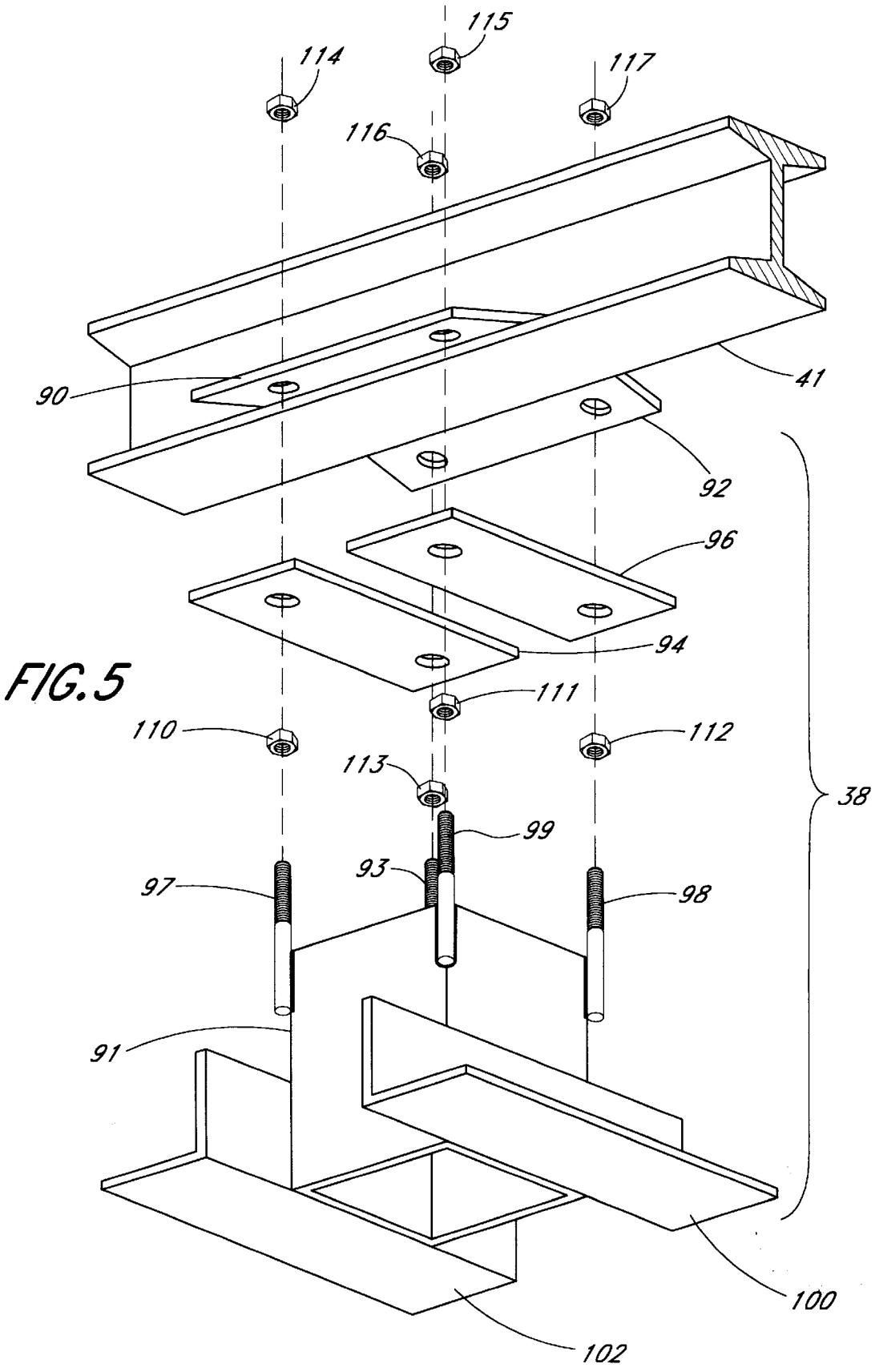
FIG. 5 illustrates an exploded perspective view of one of the support structures in FIG. 1.
Figure 6:
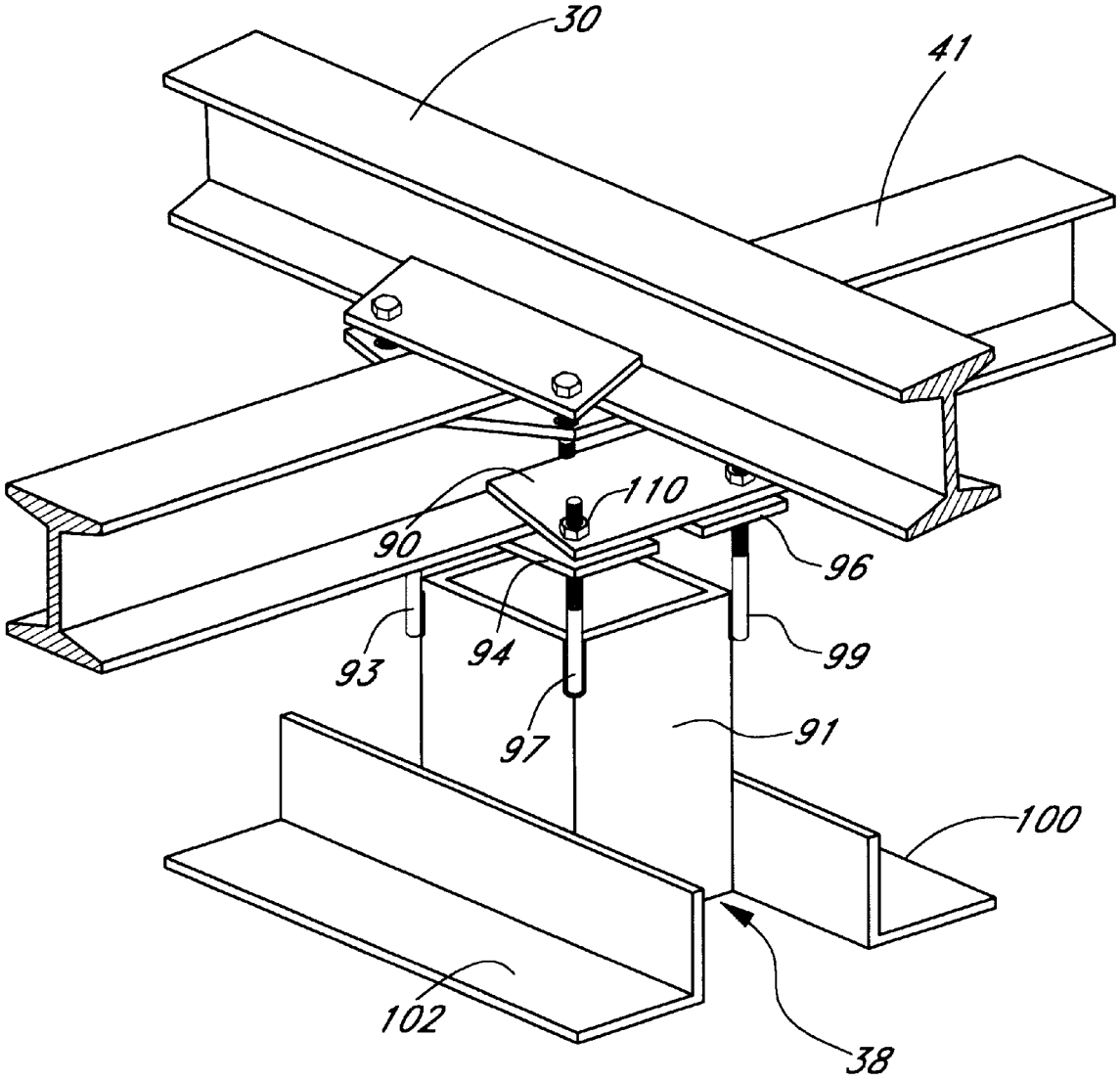
FIG. 6 illustrates a perspective view of the support structure of FIG. 5 with the elements of the support structure interconnected and with a module I-beam positioned on the support I-beam.
Figure 7:
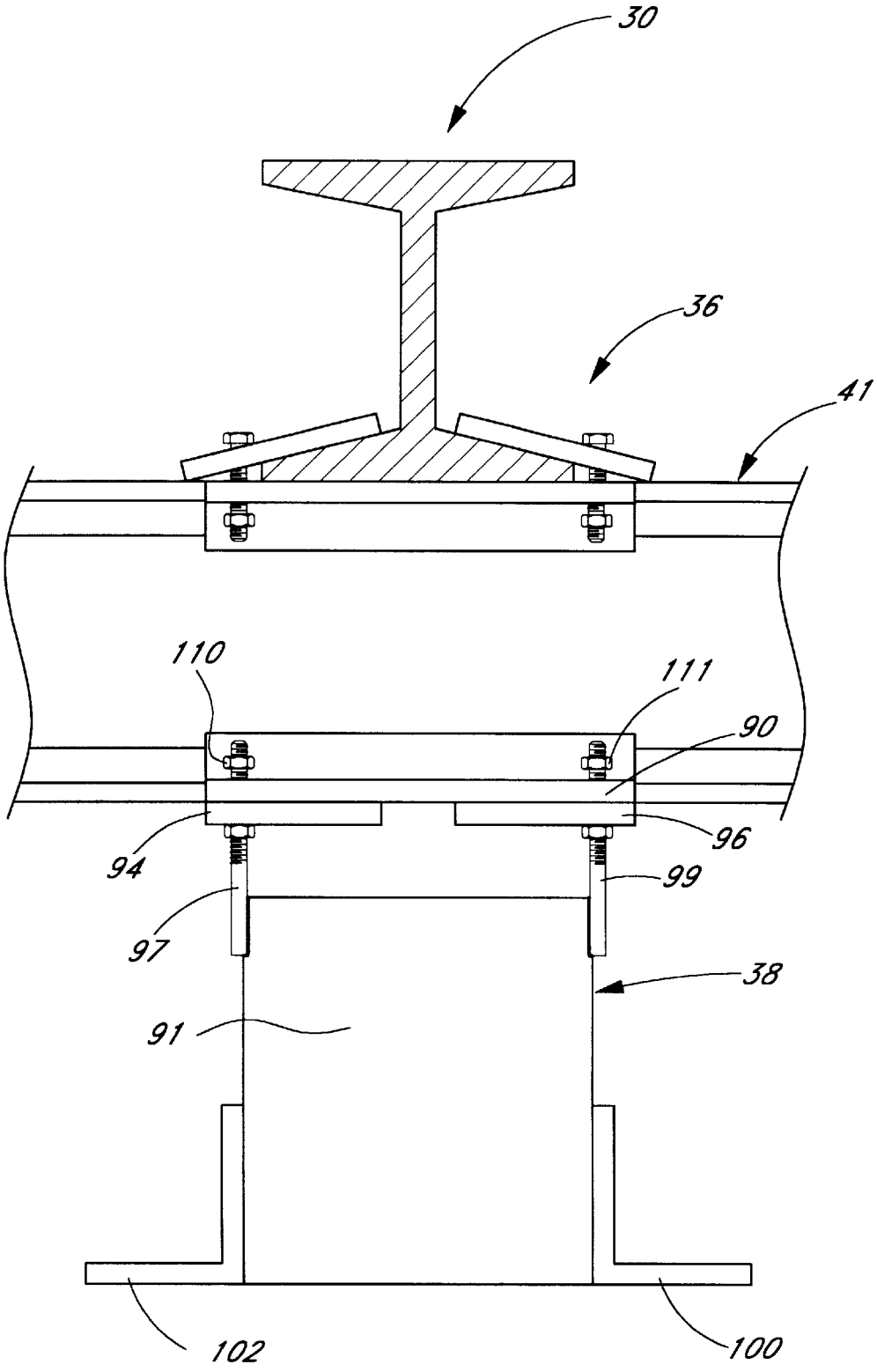
FIG. 7 illustrates an elevational view in partial cross section of the embodiment of FIG. 7.

FIGS. 5, 6 and 7 illustrates one of the piers 38 in more detail. In particular, the pier 38 beneath the intersection of the module I-beam 30 and the support I-beam 41 is illustrated. The piers beneath the other intersections are substantially the same. Furthermore, it should be understood that the piers 38 can be positioned beneath the support I-beams 40, 41, 42, 44, 46, 48, 49 at locations other than the intersections if additional support is desired. For example in FIGS. 1 and 2, a pier 38 is provided at each end of the support I-beams 40, 41, 42, 44, 46, 48, 49.

Each pier 38 comprises two horizontal angles 100, 102 which are welded to a vertical square tube 91. The square tube 91 has a height selected to provide the vertical offset from the soil or other supporting surface on which the pier 38 is placed. Four studs 93, 97, 98, 99 are positioned at the top of the tube 91 proximate to each corner and are welded to the outside of the tube 91 so that the studs 93, 97, 98, 99 extend parallel to the tube 91. As described below, the studs 93, 97, 98, 99 function as support members and are used to fasten the pier 38 to the support I-beam 41 and also to provide height adjustment to accommodate irregularities in the soil or other supporting surface. The gauge of the metal forming the square tube 91 and the sizes of the studs 93, 97, 98, 99 are selected in accordance with the length of the span between each pier 38 and the weight to be supported by each pier 38.

As further illustrated in FIGS. 5, 6 and 7, the pier 38 includes two generally rectangular support plates 94, 96 and two generally rectangular tie-down plates 90, 92. Each of the support plates 94, 96 and each of the tie-down plates 90, 92 preferably comprises structural steel and has a pair of holes formed in it proximate to opposite ends of each plate. A respective nut 110, 111, 112, 113 is positioned on each of the studs 97, 99, 98, 93 at approximately half the length of the respective stud. The support plate 94 is positioned over adjacent studs 93, 97 with the studs 93, 97 passing through the holes in the support plate 94. Similarly, the support plate 96 is positioned over the adjacent studs 98, 99 with the studs 98, 99 passing through the holes in the support plate 96. Thus, the two support plates 94, 96 are parallel to each other on opposite sides of the tube 91 and rest upon the nuts 110, 113 and the nuts 111, 112. The pier 38 is then positioned beneath the I-beam 41 with the two support plates 94, 96 oriented perpendicular to the length of the I-beam 41 so that the support plates cross the bottom of the I-beam 41 and thereby support the I-beam 41. The studs 93 and 97 are spaced sufficiently far apart and the studs 93 and 97 are spaced sufficiently far apart so that the bottom of the I-beam 41 rests between the studs 93, 97 and between the studs 98, 99. The nuts 110, 111, 112, 113 are adjustable on the studs 97, 99, 98, 93 to raise or lower the support plates 94, 96 so that the support I-beam 41 is positioned a desired distance from the surface on which the angle brackets 100, 102 of the pier 38 rests. Larger variations in height adjustment are accommodated by providing piers 38 having different lengths for the square tube 91.

After adjusting the positions of the nuts 110, 111, 112, 113, the tie-down plate 90 is positioned over the lower lip of the support I-beam 41 and parallel to the I-beam 41 with the holes in the tie-down plate 90 positioned over the studs 97, 99. Similarly, the tie-down plate 92 is positioned over the opposite lower lip of the support I-beam 41 and parallel to the I-beam 41 with the holes in the tie-down plate 92 positioned over the studs 93, 98. Respective nuts 116, 114, 117, 115 are placed over the studs 93, 97, 98, 99 and are torqued to a desired torque to securely clamp the support I-beam 41 to the pier 38.

By securing the piers 38 to the support I-beams 40, 41, 42, 44, 46, 48, 49 and by securing the support I-beams to the module I-beams 20, 22, 30, 32, as illustrated in FIGS. 6 and 7 for the module I-beam 30, the entire structure of the modules 24, 34 are tightly interconnected. It is not necessary to secure the piers to the supporting surface (e.g., soil). Thus, the overall structure is able to float or move over the ground as a total mass in the event of an earthquake or other ground movement. The present invention is thus ideal for mobile homes, modular homes and modular offices. The present invention may also be used to provide support with conventional construction for houses having floor joists which may be supported by the support I-beams by using angle brackets fastened to the wooden joists.

The present invention is particularly advantageous because highly skilled labor is not required to weld or rivet the I-beams together. Furthermore, no drilling of the I-beams is required. Thus, the structural integrity of each of the module and support I-beams is not compromised by heating or drilling as would occur in accordance with conventional interconnect methods. Furthermore, the installation is relatively easy in the cramped space beneath the modules 24, 34.

This invention may be embodied in other specific forms without departing from the essential characteristics as described herein. The embodiments described above are to be considered in all respects as illustrative only and not restrictive in any manner. The scope of the invention is indicated by the following claims rather than by the foregoing description. Any and all changes which come within the meaning and range of equivalency of the claims are to be considered within their scope.

What is claimed is:

1. An apparatus for interconnecting first and second flanged beams without modifying the beams, wherein the first beam is positioned to cross over the second beam, said apparatus comprising:

a first plate positioned on a first flange of said first beam, said first plate having a width sufficient that a portion of said first plate extends beyond said first flange of said first beam, said portion of said first plate having respective first and second holes formed therein;

a second plate positioned on a second flange of said first beam, said second plate disposed opposite said first plate, said second plate having a width sufficient that a portion of said second plate extends beyond said second flange of said first beam, said portion of said second plate having respective first and second holes formed therein;

a third plate positioned on a first flange of said second beam, said third plate having a width sufficient that a portion of said third plate extends beyond said first flange of said second beam, said portion of said third plate having respective first and second holes formed therein, said third plate positioned with said first hole of said third plate aligned with said first hole of said first plate and with said second hole of said third plate aligned with said first hole of said second plate;

a fourth plate positioned on a second flange of said second beam, said fourth plate disposed opposite said third plate, said fourth plate having a width sufficient that a portion of said fourth plate extends beyond said second flange of said second beam, said portion of said fourth plate having respective first and second holes formed therein, said fourth plate positioned with said first hole of said fourth plate aligned with said second hole of said first plate and with said second hole of said fourth plate aligned with said second hole of said second plate; and a first fastener passing through said first hole of said first plate and said first hole of said third plate, a second fastener passing through said second hole of said first plate and said first hole of said fourth plate, a third fastener passing through said first hole of said second plate and said second hole of said third plate and a fourth fastener passing through said second hole of said second plate and said second hole of said fourth plate, said fasteners tightened to securely clamp said flanges of said first and second beams between said first and second plates.

2. The apparatus as defined in claim 1, wherein said first, second, third and fourth plates are rectangular.

3. The apparatus as defined in claim 1, wherein said first, second, third and fourth plates comprise structural steel.

4. The apparatus as defined in claim 1, wherein each of said first, second, third and fourth fasteners comprises a bolt and a nut which is threaded onto said bolt tighten said each fastener.

5. An apparatus for reducing movement of first and second interconnected modular structures subject to external forces, such as earth motion, wherein the first modular structure includes at least a first flanged modular support beam oriented in a first direction and wherein the second modular structure includes at least a second flanged modular support beam in parallel with the first flanged modular support beam, said apparatus comprising:

a flanged interconnect beam for being positioned beneath said first flanged modular support beam and beneath said second flanged modular support beam and oriented in a second direction generally perpendicular to the first direction so that said flanged interconnect beam crosses said first and second flanged modular support beams;

a first clamp comprising:

first and second generally flat plates positioned to grip flanges of said fit flanged modular support beam and having third and fourth generally flat plates positioned to grip flanges of said flanged interconnect beam to secure said first flanged modular support beam to said flanged interconnect beam without modifying the structure of either said first flanged modular support beam or said flanged interconnect beam; and a plurality of fasteners which interconnect said first and second plates of said first clamp with said third and fourth plates of said first clamp, said fasteners located to preclude contact of said fasteners with said flanges of said first flanged modular support beam and said flanges of said flanged interconnect beam; and a second clamp comprising:

first and second generally flat plates positioned to grip flanges of said second flanged modular support beam and having third and fourth generally flat plates positioned to grip flanges of said flanged interconnect beam to secure said second flanged modular support beam to said flanged interconnect beam without modifying the structure of either said second flanged modular support beam or said flanged interconnect beam; and a plurality of fasteners which interconnect said first and second plates of said second clamp with said third and fourth plates of said second clamp, said fasteners located to preclude contact of said fasteners with said flanges of said second flanged modular support beam and said flanges of said flanged interconnect beam.

6. An apparatus for reducing movement of first and second interconnected modular structures subject to external forces, such as earth motion, wherein the first modular structure includes at least a first flanged modular support beam oriented in a first direction and wherein the second modular structure includes at least a second flanged modular support beam in parallel with the first flanged modular support beam, said apparatus comprising:

a flanged interconnect beam for being positioned beneath said first flanged modular support beam and beneath said second flanged modular support beam and oriented in a second direction generally perpendicular to the first direction so that said flanged interconnect beam crosses said first and second flanged modular support beams;

a first clamp having first and second generally flat surfaces positioned to grip flanges of said first flanged modular support beam and having third and fourth generally flat surfaces positioned to grip flanges of said flanged interconnect beam to secure said first flanged modular support beam to said flanged interconnect beam without modifying the structure of either said first flanged modular support beam or said flanged interconnect beam, said first clamp comprising:

a first plate having said first surface for being positioned in contact with a first flange of said first flanged modular support beam, said first plate having a width sufficient that a portion of said first plate extends beyond said first flange of said first flanged modular support beam, said portion of said first plate having respective first and second holes formed therein;

a second plate having said second surface for being positioned in contact with a second flange of said first flanged modular support beam, said second plate disposed opposite said first plate, said second plate having a width sufficient that a portion of said second plate extends beyond said second flange of said first modular support beam, said portion of said second plate having respective first and second holes formed therein;

a third plate having said third surface for being positioned in contact with a first flange of said flanged interconnect beam, said third plate having a width sufficient that a portion of said third plate extends beyond said first flange of said flanged interconnect beam, said portion of said third plate having respective first and second holes formed therein, said third plate positioned with said first hole of said third plate aligned with said first hole of said first plate and with said second hole of said third plate aligned with said first hole of said second plate;

a fourth plate having said fourth surface for being positioned in contact with a second flange of said flanged interconnect beam, said fourth plate disposed opposite said third plate, said fourth plate having a width sufficient that a portion of said fourth plate extends beyond said second flange of said flanged interconnect beam, said portion of said fourth plate having respective fist and second holes formed therein, said fourth plate positioned with said first hole of said fourth plate aligned with said second hole of said fist plate and with said second hole of said fourth plate aligned with said second hole of said second plate; and a first fastener passing through said first hole of said first plate and said first hole of said third plate, a second fastener passing through said second hole of said first plate and said first hole of said fourth plate, a third fastener passing through said first hole of said second plate and said second hole of said third plate and a fourth fastener passing through said second hole of said second plate and said second hole of said fourth plate, said fasteners tightened to securely clamp said flanges of said first flanged modular support beam and said flanged interconnect beam between said first and second plates; and a second clamp having first and second generally flat surfaces positioned to grip flanges of said second flanged modular support beam and having third and fourth generally flat surfaces positioned to grip flanges of said flanged interconnect beam to secure said second flanged modular support beam to said flanged interconnect beam without modifying the structure of either said second flanged modular support beam or said flanged interconnect beam, said second clamp comprising:

a first plate having said first surface for being positioned in contact with a first flange of said second flanged modular support beam, said first plate having a width sufficient that a portion of said first plate extends beyond said first flange of said second flanged modular support beam, said portion of said first plate having respective first and second holes formed therein;

second plate having said second surface for being positioned in contact with a second flange of said second flanged modular support beam, said second plate disposed opposite said first plate, said second plate having a width sufficient that a portion of said second plate extends beyond said second flange of said second modular support beam, said portion of said second plate having respective first and second holes formed therein;

a third plate having said third surface for being positioned in contact with a first flange of said flanged interconnect beam, said third plate having a width sufficient that a portion of said third plate extends beyond said first flange of said flanged interconnect beam, said portion of said third plate having respective first and second holes formed therein, said third plate positioned with said first hole of said third plate aligned with said first hole of said first plate and with said second hole of said third plate aligned with said first hole of said second plate;

a fourth plate having said fourth surface for being positioned in contact with a second flange of said flanged interconnect beam, said fourth plate disposed opposite said third plate, said fourth plate having a width sufficient that a portion of said fourth plate extends beyond said second flange of said flanged interconnect beam, said portion of said fourth plate having respective first and second holes formed therein, said fourth plate positioned with said first hole of said fourth plate aligned with said second hole of said first plate and with said second hole of said fourth plate aligned with said second hole of said second plate; and a first fastener passing through said first hole of said first plate and said first hole of said third plate, a second fastener passing through said second hole of said first plate and said first hole of said fourth plate, a third fastener passing through said first hole of said second plate and said second hole of said third plate and a fourth fastener passing through said second hole of said second plate and said second hole of said fourth plate, said fasteners tightened to securely clamp said flanges of said second flanged modular support beam and said flanged interconnect beam between said first and second plates.

7. The apparatus as defined in claim 6, wherein said first, second, third and fourth plates are rectangular.

8. The apparatus as defined in claim 6, wherein said first, second, third and fourth plates comprise structural steel.

9. The apparatus as defined in claim 6, wherein each of said first, second, third and fourth fasteners comprises a bolt and a nut which is threaded onto said bolt to tighten said each fastener.

10. A method of interconnecting flanged beams, said method comprising the steps of:

positioning a first plate on a first flange of a first beam with a first portion of said first plate in contact with said first flange and a second portion of said first plate extending beyond said first flange of said first beam, said second portion of said first plate having respective first and second holes formed therein;

positioning a second plate on a second flange of said first beam opposite said position of said first plate, said second plate positioned with a first portion in contact with said second flange of said first beam and with a second portion extending beyond said second flange of said first beam, said second portion of said second plate having respective first and second holes formed therein;

positioning a third plate on a first flange of a second beam with a first portion of said third plate in contact with said first flange of said second beam and with a second portion of said third flange extending beyond said first flange of said second beam, said second portion of said third plate having respective first and second holes formed therein, said third plate positioned on said first flange of said second beam to align said first hole of said third plate with said first hole of said first plate and to align said second hole of said third plate with said first hole of said second plate;

positioning a fourth plate on a second flange of said second beam opposite said position of said third plate, said fourth plate positioned with a first portion of said fourth plate in contact with said second flange of said second beam and with a second portion extending beyond said second flange of said second beam, said second portion of said fourth plate having respective first and second holes formed therein, said fourth plate positioned on said second flange of said second beam to align said first hole of said fourth plate with said second hole of said first plate and to align said second hole of said fourth plate with said second hole of said second plate;

passing a first fastener through said first hole of said first plate and said first hole of said third plate;

passing a second fastener through said second hole of said first plate and said first hole of said fourth plate;

passing a third fastener through said first hole of said second plate and said second hole of said third plate;

passing a fourth fastener through said second hole of said second plate and said second hole of said fourth plate; and tightening said first, second, third and fourth fasteners to securely clamp said flanges of said first and second beams between said first and second and said third and fourth plates.

11. The method as defined in claim 10, wherein said first, second, third and fourth plates are rectangular.

12. The method as defined in claim 10, wherein said first, second, third and fourth plates comprise structural steel.

13. An adjustable support for a horizontally disposed flanged beam having first and second flanges on a lower portion thereof, said support comprising:

a support column which provides a first non-varying length for said support, said column having a first end which rests on a supporting surface and having a second end;

first, second, third and fourth threaded support members positioned proximate to said second end of said support column, said first, second, third and fourth threaded support members oriented in parallel with each other and in parallel with said support column;

first, second, third and fourth threaded adjustment members positioned on said first, second, third and fourth threaded support members, respectively, said threaded adjustment members rotating on said support members to move up and down said support members to thereby vary a distance of each of said adjustment members from said first end of said support column;

a first plate having first and second holes, said first plate positioned on said first and second threaded adjustment members with said first and second threaded support members passing through said first and second holes, respectively;

a second plate having first and second holes, said second plate positioned on said third and fourth threaded adjustment members generally in parallel with said first plate and with said third and fourth threaded support members passing through said first and second holes, respectively, said first and second flanges of said flanged beam resting on said first and second plates and positioned with said first and fourth threaded members proximate to said first flange and with said second and third threaded members proximate to said second flange;

a third plate positioned over said first flange with a first portion of said third plate contacting said first flange and with a second portion of said third plate extending beyond said first flange, said second portion having a first hole and a second hole, said first threaded member passing through said first hole of said third plate, said fourth threaded member passing through said second hole of said third plate;

a fourth plate positioned over said second flange with a first portion of said fourth plate contacting said second flange and with a second portion of said fourth plate extending beyond said second flange, said second portion having a first hole and a second hole, said second threaded member passing through said first hole of said fourth plate, said third threaded member passing through said second hole of said fourth plate;

first, second, third and fourth threaded fasteners applied to said first, second, third and fourth threaded support members, respectively, above said third and fourth plates, said first, second, third and fourth fasteners clamping said first and second flanges between said first and second plates and said third and fourth plates when said threaded fasteners are rotated to advance said threaded fasteners toward said threaded adjustment members.

14. The adjustable support as defined in claim 13, wherein said first, second, third and fourth plates are rectangular.

15. The adjustable support as defined in claim 13, wherein said first, second, third and fourth plates comprise structural steel.

16. An adjustable support for a horizontally disposed flanged beam having first and second flanges on a lower portion thereof, said support comprising:

a support column which provides a first non-varying length for said support, said column having a first end which rests on a supporting surface and having a second end;

first, second, third and fourth vertical support members positioned proximate to said second end of said support column;

first, second, third and fourth adjustment members positioned on said first, second, third and fourth support members, respectively, said adjustment members movable along said support members to vary a vertical distance of said support members from said surface;

a first plate mounted on said first and second support members above said first and second adjustment members;

a second plate mounted on said third and fourth support members above said third and fourth adjustment members, said second plate generally in a same plane with said first plate so that said first and second flanges of said flanged beam rests on said first and second plates;

third plate mounted on said first and fourth support members and positioned over said first flange;

a fourth plate mounted on said second and third support members and positioned over said second flange; and first, second, third and fourth fasteners applied to engage said first, second, third and fourth support members, respectively, above said third and fourth plates, said fasteners movable toward said adjustment members to clamp said first and second flanges between said first and second plates and said third and fourth plates.

* * * * *

UNITED STATES PATENT AND TRADEMARK OFFICE

CERTIFICATE OF CORRECTION

PATENT NO. : 6,009,674

DATED : January 4, 2000

INVENTOR : Warren Root

It is certified that error appears in the above-identified patent and that said Letters Patent is hereby corrected as shown below:

In column 10 at line 56, change "fist and" to --first and--.

In column 10 at line 59, change "said fist" to --said first--.

In column 14 at line 41, change "third plate" to --a third plate--.

Signed and Sealed this

Twenty-second Day of May, 2001

*Attest:*

Nicholas P. Godici

NICHOLAS P. GODICI

*Attesting Officer*

*Acting Director of the United States Patent and Trademark Office*